US009068786B2

(12) United States Patent
DiChario

(10) Patent No.: US 9,068,786 B2
(45) Date of Patent: Jun. 30, 2015

(54) HYBRID UPPER RECEIVER FOR A RIFLE

(71) Applicant: American Tactical Imports, Inc., Rochester, NY (US)

(72) Inventor: Anthony DiChario, Pittsford, NY (US)

(73) Assignee: American Tactical Imports, Inc., Rochester, NY (US)

( * ) Notice: Subject to any disclaimer, the term of this patent is extended or adjusted under 35 U.S.C. 154(b) by 0 days.

(21) Appl. No.: 14/081,347

(22) Filed: Nov. 15, 2013

(65) Prior Publication Data

US 2015/0135573 A1 May 21, 2015

(51) Int. Cl.
*F41A 21/00* (2006.01)
*F41A 3/66* (2006.01)

(52) U.S. Cl.
CPC ..... *F41A 3/66* (2013.01)

(58) Field of Classification Search
USPC ..... 42/75.02, 14, 2, 6; 89/162
See application file for complete search history.

(56) References Cited

U.S. PATENT DOCUMENTS

| | | | | |
|---|---|---|---|---|
| 8,356,439 | B2 * | 1/2013 | Dubois | 42/49.02 |
| 8,789,305 | B1 * | 7/2014 | DiChario | 42/75.03 |
| 2010/0162604 | A1 * | 7/2010 | Dubois | 42/18 |

* cited by examiner

*Primary Examiner* — J. Woodrow Eldred
(74) *Attorney, Agent, or Firm* — Woods Oviatt Gilman LLP; Katherine H. McGuire, Esq.

(57) ABSTRACT

A combination metal/polymer upper receiver for use in a rifle, with the upper receiver attachable to a lower receiver and to a barrel. The upper receiver comprises a polymeric upper receiver housing defining a chamber. The polymeric upper receiver housing is adapted to engage with mounting features on the lower receiver to attach a lower receiver to the upper receiver at a first connection. A metal insert is secured within the polymeric upper receiver housing and is adapted to engage the barrel. The metal insert further includes an extended member embedded within the polymeric upper receiver housing such that the extended member receives the impact from a bolt carrier group residing within the chamber. An optional metal gas tube channel is located along an upper internal surface of the polymeric upper receiver housing and extends the length of the polymeric upper receiver housing.

5 Claims, 8 Drawing Sheets

HYBRID UPPER RECEIVER FOR A RIFLE

FIELD OF THE INVENTION

The present invention relates to a rifle, and more particularly, to a modular automatic or semi-automatic assault-type rifle. Specifically, the present invention relates to an upper receiver assembly configured for use within a modular assault-type rifle.

BACKGROUND OF THE INVENTION

There are a number of automatic and semi-automatic rifles used by military personnel as well as law enforcement and civilians. While fully automatic rifles are generally illegal for use by the civilian population, many of the components which constitute an automatic rifle are the same as those found within semi-automatic models legalized for civilian use. Arguably the most popular semi-automatic assault-type rifle used by civilians, particularly within the United States, is the AR-15 and its clones. AR-15 is a registered trademark of Colt Industries. A number of additional companies manufacture clones of the AR-15 and market these clones under separate trademarks. While used throughout the specification, it is to be understood that the term AR-15 is meant to include not only those rifles manufactured by Colt Industries, but also those additional clones and any variants thereof. The AR-15 is the semi-automatic variant of the fully automatic M16 rifle used by United States military personnel.

The AR-15 and M16 are designed as modular rifles generally comprising a buttstock, lower receiver, upper receiver and barrel assembly. Each component is separable from one another and affords rifle owners the opportunity to customize the rifle with after-market components such as barrels of differing lengths, upper receivers designed to handle different calibers of ammunition, flashlights, hand guards, grenade or flare launchers, flash or sound suppressors, grips, and front or rear sights. To operate, the lower receiver is configured to include a trigger and magazine box wherein activation of the trigger causes a round (bullet) housed within the chamber of the upper receiver to be fired out the barrel of the rifle by action of a reciprocating bolt carrier group housed within the upper receiver. Internal mechanisms of the upper receiver expel the shell casing of the fired round from the chamber while components engaged with the magazine box housed within the lower receiver feed a new round into the now-empty chamber. The buttstock mounts to the lower receiver and includes a buffer assembly and action (or recoil) spring in communication with the bolt carrier group. After a spent shell has been discharged, the spring urges the bolt carrier group back toward the chamber in preparation for firing another round.

The modular construction of these rifles enables generally quick and easy field-stripping (disassembly of the rifle for cleaning of the rifle to ensure proper firing of the weapon). In field-stripping the rifle, the lower receiver is separated from the upper receiver to gain access to the firing mechanism (bolt, bolt carrier and associated mechanisms) for cleaning and re-lubrication. When assembled, the upper and lower receivers are secured to one another through rear and forward extensions on the upper receiver fitting between corresponding sidewalls forming notches or grooves on the lower receiver. The forward sidewalls and extension are fitted with a pivot pin to prevent the forward halves of the receivers from separating. Similarly, the rear sidewalls and extension employ a takedown pin to secure the two receivers together. To field-strip the rifle, the takedown pin is sufficiently pushed out of the extension so as to enable the rear extension to lift out of the rear sidewalls thereby pivoting the lower and upper receivers about the pivot pin. The pivot pin can then be pushed out a sufficient distance so as to enable removal of the front extension from the front sidewalls and thereby completing separation of the lower receiver from the upper receiver.

While the AR-15 and M16 can be constructed of aircraft grade forged aluminum, a trend in manufacturing current firearms/firearm components is to interchange metal parts/components with high strength polymeric materials, such as glass reinforced nylon, whenever possible. These polymeric parts/components decrease the weight of the rifle while also decreasing material costs associated with fabrication of the rifle or individual rifle parts. One drawback in polymeric components, however, is the eventual wear of these components after repeated field-stripping, cleaning and reassembly. This is of particular importance with regard to the upper and lower receivers and the takedown and pivot pins. Any substantial wear to any of the components results in an unsafe and unusable firearm. A further drawback to a polymeric upper receiver is the potential for fatigue or cracking of the upper receiver through repeated impacts upon the polymer by the reciprocating bolt carrier group.

Further, typical rifle systems employ a gas tube running from the forward sight post on the barrel to the chamber within the upper receiver. Hot gas is generated during the firing of a round. A portion of this hot gas enters the gas tube where it travels back to the chamber. Hot gas entering the chamber forces the bolt and bolt carrier rearward against the buffer spring and leads to extraction and ejection of the spent round. The buffer spring then propels the bolt and carrier forward where another round is loaded from the magazine. The repeated exposure to hot gas may lead to melting, brittling or other premature failure of a polymeric upper receiver.

Still further, polymeric upper receivers may fail due to flexing or bowing of the receiver, particularly the top portions thereof. The upper receiver must be a generally hollow structure so as to house the bolt carrier group and form the chamber. As a result, the upper receiver is generally constructed as a thin walled member. Part of the appeal of the modular rifle, and particularly the AR-15, is that the rifle can be modified/customized with after-market accessories as described above. However, these accessories weigh on the rails which are formed along the top surface of upper receiver. This additional weight can lead to flexing or bowing of the thin-walled polymer, thereby leading to an unsafe or inoperable rifle.

As such, there is a need for an upper receiver assembly which capitalizes upon the weight and cost savings afforded by polymeric materials while also enjoying the mechanical and structural strength afforded by metal (i.e. aircraft grade aluminum). The present invention addresses these and other needs.

BRIEF SUMMARY OF THE INVENTION

In general, one embodiment the present invention is directed to an upper receiver assembly constructed as a polymeric/metal hybrid wherein the bulk of the upper receiver assembly is constructed of molded polymeric materials with the portion adapted to engage the barrel constructed of a metal, and optionally further incorporating a metal channel along the upper internal surface of the receiver, the channel configured to receive exposure to hot gasses.

Preferably, the metal portions including the barrel receiving member and the channel are configured to be surrounded by the polymeric portion of the hybrid upper receiver such that the completed assembly is a single, contiguous construction. The metal portion of the barrel receiving member is positioned so as to engage the locking nut of the barrel, and more preferably includes an extended portion adapted to receive the repeated impacts of the bolt carrier when the rifle is discharged and reset. The metal portion constitutes a gas channel which extends a substantial length of the upper internal surface of the upper receiver such that hot gasses communicated from the barrel through the gas tube to the upper receiver assembly have minimal contact with the polymeric portions of the hybrid upper receiver.

The embodiments of the present invention are well-suited to reduce material costs while also maintaining structural integrity of the upper receiver assembly even after the firing of multiple rounds.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
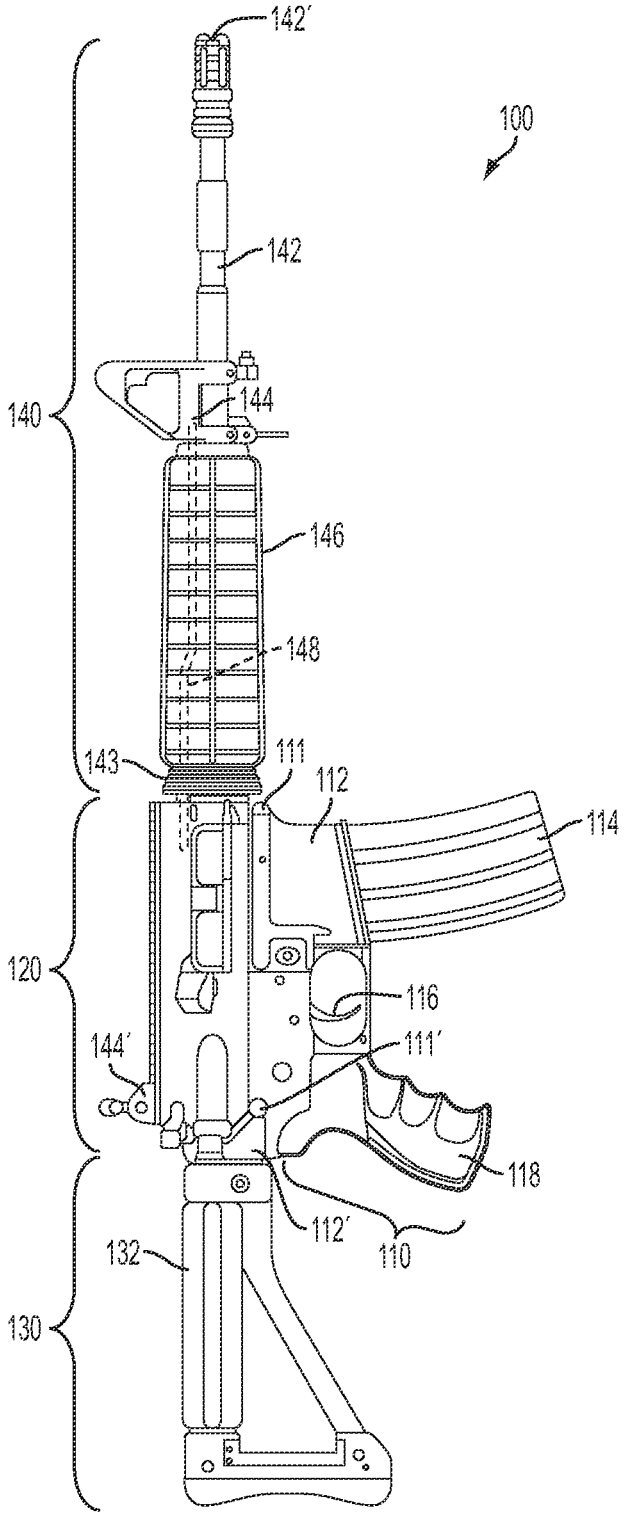
FIG. 1 is a side view of a representative modular rifle suitable for incorporating an embodiment of a hybrid upper receiver in accordance with present invention.
Figure 2:
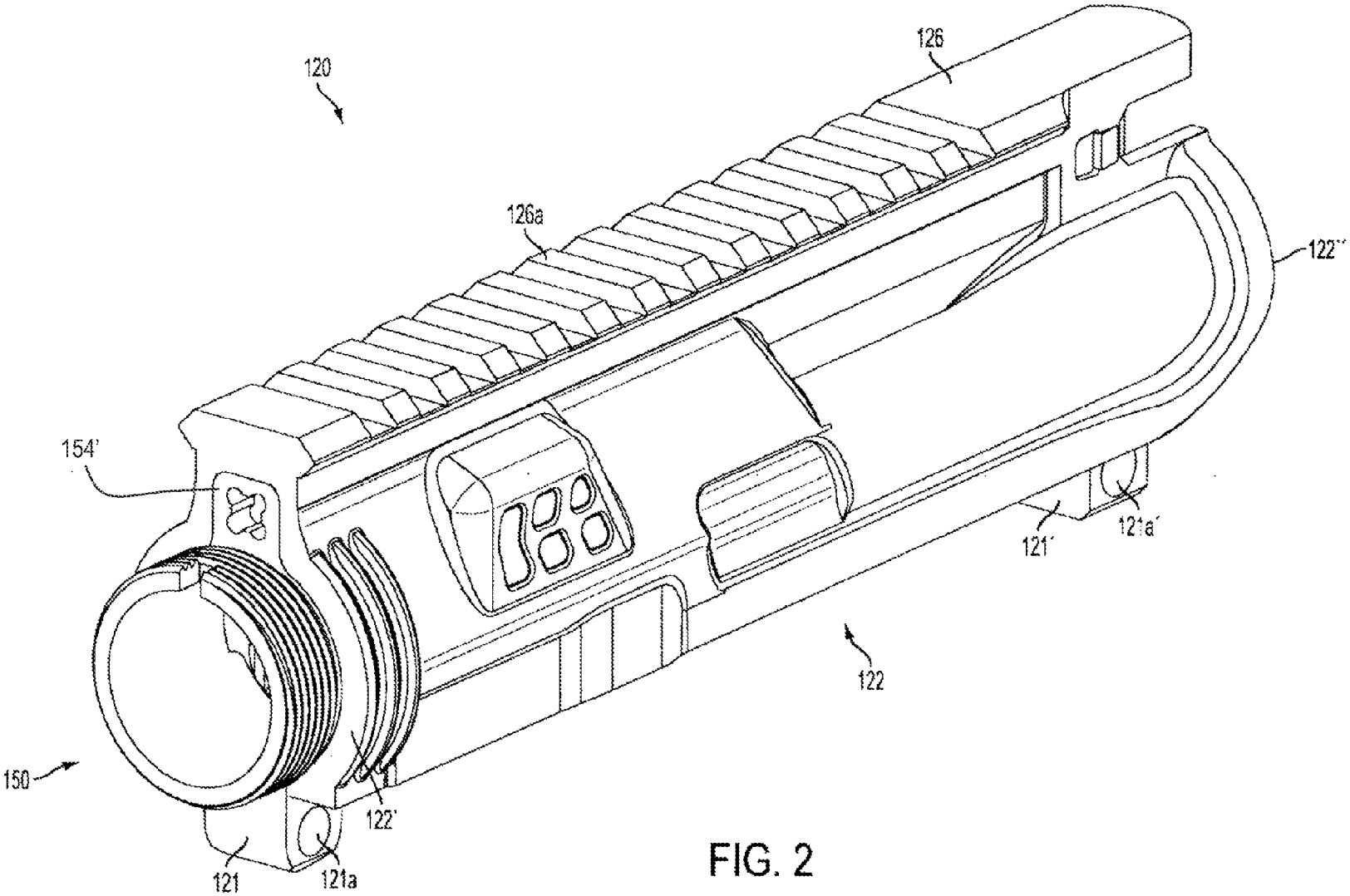
FIG. 2 is a perspective view of an upper receiver in accordance with an embodiment of the present invention.

Referring to the drawings in detail, and specifically to FIG. 1, a rifle, such as the AR-15, is generally indicated by reference numeral 100. Rifle 100 is a modular firearm consisting of a number of components and subcomponents. Major components of rifle 100 include lower receiver assembly 110, upper receiver assembly 120, buttstock assembly 130 and barrel assembly 140. To assemble a completed rifle, upper receiver assembly 120 is positioned atop lower receiver assembly 110 such that rear and front projections 121 and 121', respectively, on the upper receiver assembly (see FIG. 2) rest within a notch or groove formed within the sidewalls of the lower receiver assembly (not shown). Each projection and respective sidewalls include corresponding through-holes. A respective pin is inserted into and passes within each through-hole to secure the two receiver assemblies together. Pivot pin 111 detachably secures the front projection 121 of the upper receiver assembly within the lower receiver assembly while takedown pin 111' secures the rear projection 121'.

Upper receiver assembly 120 includes an upper receiver housing 122 having a chamber 124 which holds a round (bullet) in position for firing, along with the bolt carrier group to initiate discharging of the round. The bolt carrier group generally includes a bolt, bolt carrier, charging handle and related mechanisms.

Barrel assembly 140 is secured to upper receiver housing 122 generally through a threaded connection and includes a barrel 142 in operational communication with the chamber 124 of the upper receiver housing such that a round fired from the chamber 124 passes down the length of the barrel and exits the firearm at barrel end 142'. Barrel assembly 140 generally includes a forward sight mount 144, which in conjunction with rear sight 144', assists the user in aiming the rifle. A gas tube 148 is generally mounted within the forward sight mount and passes within the space located between the barrel 142 and hand guard 146. One end of the gas tube is in fluid communication with the bore of the barrel at the forward sight mount while the second end of the gas tube is in fluid communication with the chamber of the upper receiver housing. Thus, at least a portion of the hot gas produced during the firing of a round is redirected from the barrel to the upper receiver housing through the gas tube.

Rounds are introduced into the chamber by way of magazine 114 fitted to the lower receiver housing 112 of the lower receiver assembly 110. Activation of the firing mechanism is controlled by trigger 116. A grip 118 (such as a pistol grip, as shown) allows the user to aim and control the rifle while placing the user's trigger index finger in close proximity to the trigger. In this manner, the user can aim the rifle to the target and extend the trigger index finger to engage the trigger without losing control or accuracy of the rifle.

Lower receiver housing 112 includes an upwardly extending lobe 112'. Buttstock assembly 130 is detachably mounted to upwardly extending lobe 112' so that a receiver extension 132 is in operational alignment with the bolt carrier housed within the upper receiver. Receiver extension 132 generally houses an action (or recoil) spring and buffer assembly (not shown). Upon discharge of a round, the bolt carrier within the upper receiver housing is driven rearward by action of the gas discharged through the firing action. The buffer assembly and action spring dampen the kickback experienced by the user while also redirecting the bolt carrier group back toward the chamber in preparation for firing another round.

Modular rifles are generally constructed of aircraft grade forged aluminum. However, a current manufacturing trend is to interchange metal parts/components with high strength polymeric materials, such as glass reinforced nylon, whenever possible, including both the upper and lower receivers. Polymeric parts/components decrease the weight of the rifle while also decreasing material costs associated with fabrication of the rifle parts. One drawback in polymeric components, however, is the eventual wear of these components after repeated field-stripping, cleaning and reassembly, as well as through the stresses and vibrations experienced by the rifle when being fired repeatedly. These drawbacks are of particular importance with regard to the upper receiver assembly, with particular attention to the upper receiver/barrel threaded connection and the forward pivot pin and associated sidewalls, nodules and through-holes. Any substantial wear to any of these particular components results in an unsafe and unusable firearm.

A further drawback to a polymeric upper receiver is the potential for fatigue or cracking of the upper receiver. This potential may be due to a number of reasons. First, as described earlier, gas produced by the firing of a round is redirected from the barrel back to the upper receiver housing to cause proper recoil and reloading actions of the fire control group and bolt carrier group. Importantly, these gasses are extremely hot and, through repeated contact with the polymeric upper receiver housing, may cause thermal breakdown or other damage to the housing material. Thermal breakdown may lead to serious hazards such as rifle inoperability or even explosion of the upper receiver housing.

Second, the upper receiver housing may be fabricated to include a picatinny rail system. A number of after-market accessories have been developed for mounting onto this rail system, thereby affording the rifle owner the opportunity to modify/customize his or her rifle. However, the constant load of these accessories, or the mounting of one or more overly heavy accessories, may cause the polymeric upper receiver housing to flex. Any flex of the upper receiver housing may damage the internal components of the bolt carrier group and may further lead to an inoperable rifle.

Figure 3:
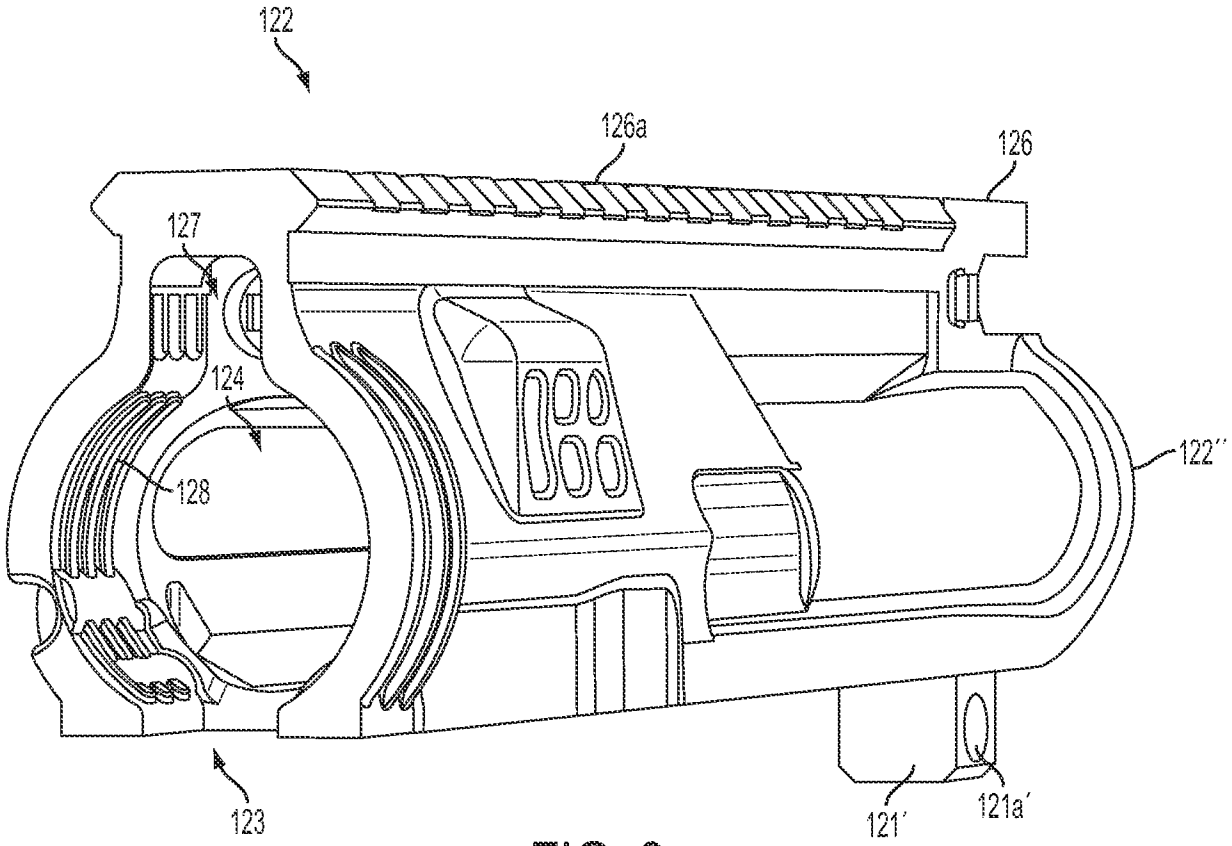
FIG. 3 is a perspective view of a polymeric upper receiver housing in accordance with an embodiment of the present invention.

As shown in FIGS. 2-7, an embodiment of an upper receiver assembly of the present invention includes a metal/polymer hybrid upper receiver assembly 120 comprised of a generally cylindrical polymeric tubular upper receiver housing 122. Embedded within the polymeric housing at the barrel end 122' is a threaded metal insert 150 which will be discussed in greater detail later, with particular reference to FIGS. 3 and 4. Buttstock end 122" is adapted to engage with the upwardly extending lobe of the lower receiver assembly (lobe 112' as shown in FIG. 1). As described previously, the polymeric upper receiver housing 122 further comprises a downwardly extending nodule 121'. Nodule 121' includes a through-hole 121*a'* which corresponds with through-holes within the lower receiver housing such that take down pin 111' passes within the through-holes to secure upper and lower receivers together. As seen in FIG. 3, upper receiver housing 122 includes a recess 123 adapted to accept and secure downwardly extending nodule 121 of the threaded metal insert (as will be discussed in further detail below with regard to FIGS. 4 and 5). Upper receiver housing similarly includes a pocket 127 configured to conform about lobe 154 of the threaded metal insert. Extending substantially along the entire top surface of the upper receiver housing 122 is ridge 126. In preferred embodiments, ridge 126 is fabricated so as to form an integral picatinny rail system 126*a*.

Figure 4:
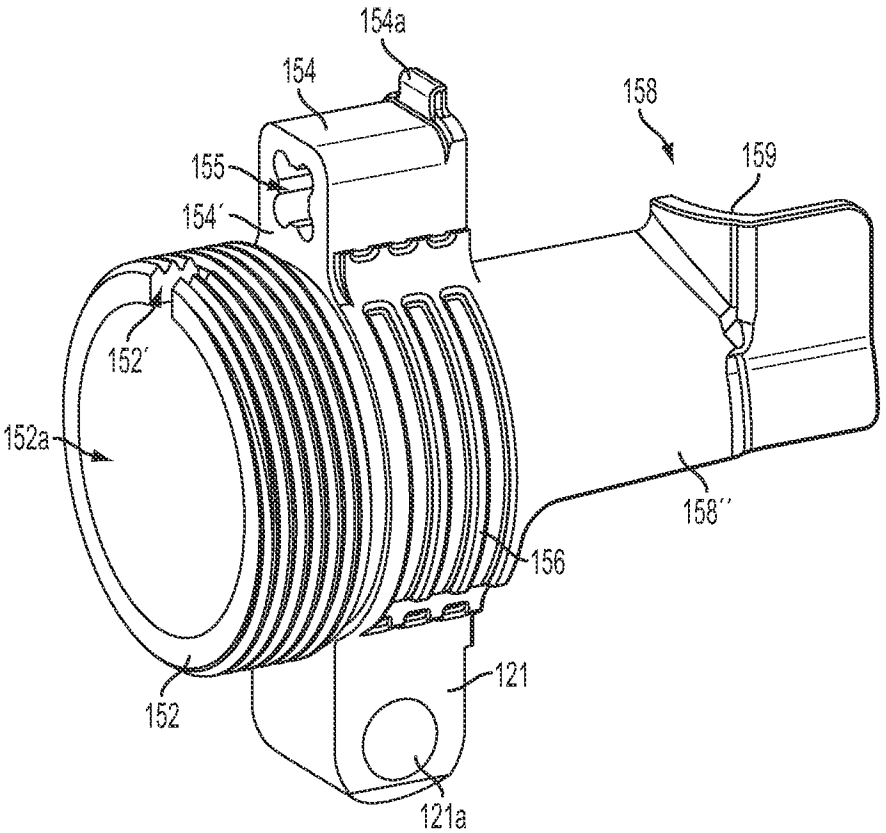
FIG. 4 is a front perspective view of a threaded metal insert in accordance with an embodiment of the present invention (with the metal insert removed)
Figure 5:
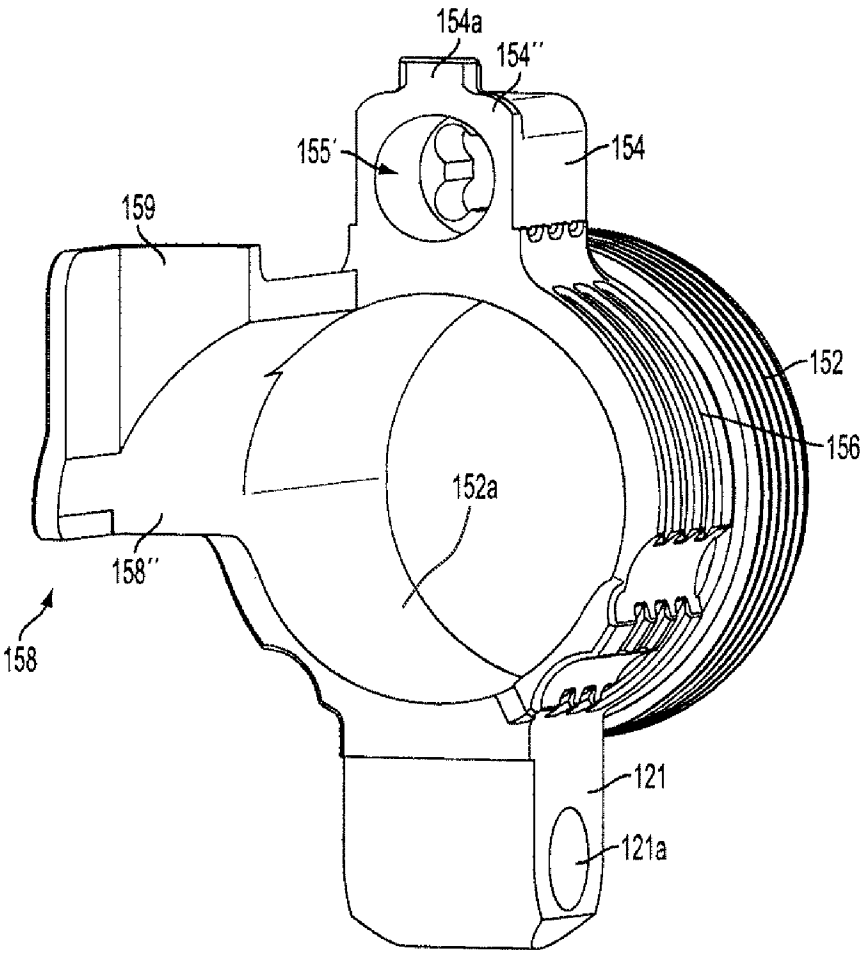
FIG. 5 is a rear perspective view of a threaded metal insert in accordance with an embodiment of the present invention.

As shown in FIGS. 4 and 5, threaded metal insert 150 includes a generally cylindrical portion comprised of threaded member 152 and ribbed member 156. The cylindrical portion is fabricated so as to have a generally smooth internal bore 152*a* adapted to communicate with chamber 124 (see FIG. 3). Threaded member 152 includes a cut-out 152' adapted to engage a corresponding pin (not shown) situated on barrel 142. The pin/cut-out engagement ensures that the barrel is properly oriented onto the upper receiver assembly and also prevents the barrel from rotating as the barrel nut 143 (see FIG. 1) is tightened. As made evident by the above recitation, provision of a metal threaded member 152 provides numerous advantages over a threaded polymer connection. First, the entire length of barrel 142 is solely supported by the threaded member. Adding of accessories onto hand guard rails further increases the weight of the barrel and the load placed upon this threaded connection. A wholly polymeric upper receiver assembly may crack at this point of connection, particularly when subjected to this additional weight. Additionally, the barrel nut 143 used to secure the barrel to the upper receiver is generally threaded to at least 65 pounds of torque. Polymer threads would strip at these torque weights. Similarly, upon tightening of the barrel nut 143, the pin of the barrel would impact and distort the corresponding polymeric cut-out. Over time, this would lead to misalignment of the barrel with the upper receiver assembly and make alignment and insertion of the gas tube more difficult.

Ribbed member 156 is adapted to be over-molded with corresponding polymeric ribbed material 128 fabricated in the upper receiver housing 122 (see FIGS. 2, 3, 7 and 8). The exterior surface of ribbed member 156 includes a number or raised and/or depressed surface features which mate with corresponding internal surface features of the upper receiver housing. These mating features lock the metal insert within the polymeric housing and help prevent axial and/or lateral displacement of the metal insert 150 during operation of the rifle or when the barrel is mounted onto or removed from the upper receiver assembly 120.

Depending downwardly from ribbed member 156 is nodule 121. Nodule 121 is adapted to carry a through-hole 121*a*. As described previously, nodule 121 rests within the sidewalls of the lower receiver assembly such that a pivot pin 111 can be inserted into and pass through the sidewalls and nodule to secure the upper and lower receiver assemblies. Importantly, nodule 121 is not embedded within the polymer which comprises the upper receiver housing. By being an integral part of the threaded metal insert 150, nodule 121 is able to absorb recoil experienced by the metal insert during the discharge of the rifle. This recoil absorption minimizes wear and tear on the upper receiver assembly.

Ribbed member 156 further includes an upwardly protruding lobe 154. Lobe 154 is preferably embedded within the polymer of the upper receiver housing 122, with the exception of barrel face 154' which remains exposed (see FIGS. 2, 7 and 8). Lobe 154 is adapted to carry a thorough-bore having a cloverleaf cross-section opening 155 (see FIG. 4) on barrel face 154' and a generally circular cross-section opening 155' on receiver face 154" (see FIG. 5). The through-bore is sized to accommodate insertion of gas tube 148 snuggly through the cloverleaf opening 155 while passing the gas tube out circular opening 155' situated within the upper receiver housing 122. In this manner, gas may be redirected from the barrel to the chamber as required for proper functioning of the rifle. Preferably, the width of the cloverleaf opening accounts for only a fraction of the total width of lobe 154, and more preferably between one quarter (¼) and one half (½) of the overall width of the lobe. The reduced width of the cloverleaf opening is sufficient to maintain the lateral, horizontal and vertical positions of the gas tube within the upper receiver housing, but is small enough to limit thermal conductance as hot gas passes through the gas tube where the gas tube contacts the metal of the lobe.

In a preferred embodiment, threaded metal insert 150 further incorporates an extended member 158 directed rearward toward the chamber 124 (see FIG. 3). The terminal end of extended member 158 is configured to include an impact surface 159. The lateral distance covered by the extended member 158 is selected such that the impact surface 159 rests within the upper receiver housing such that a cam pin in the bolt carrier group (not shown) strikes the impact surface 159 upon recharging of the bolt carrier group. In this manner, repeated impacts are directed toward the metal insert 150 and not toward the polymeric material composing the upper receiver housing 122.

Figure 6:
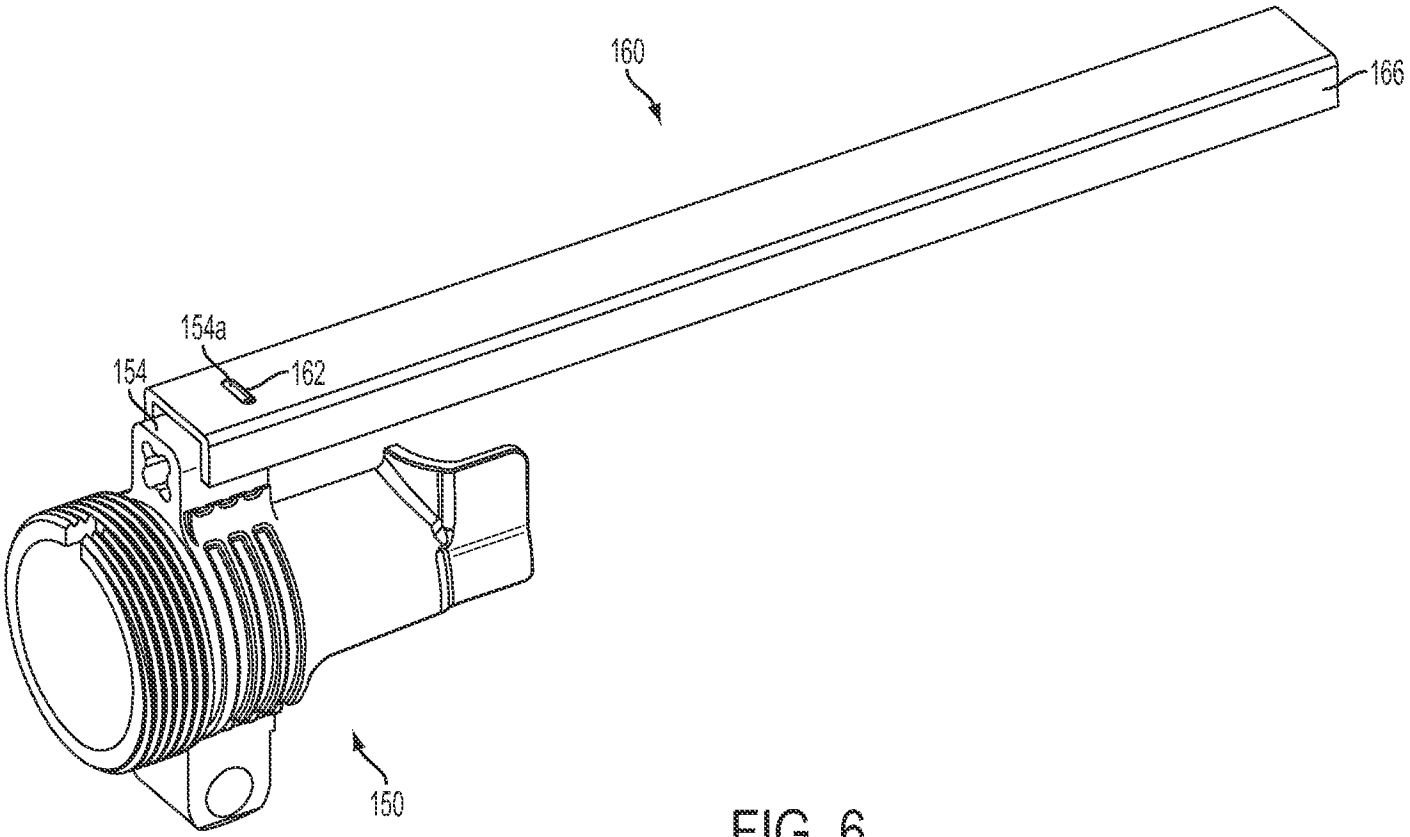
FIG. 6 is a perspective view of a threaded metal insert with a metal gas channel member in accordance with an embodiment of the present invention.
Figure 7:
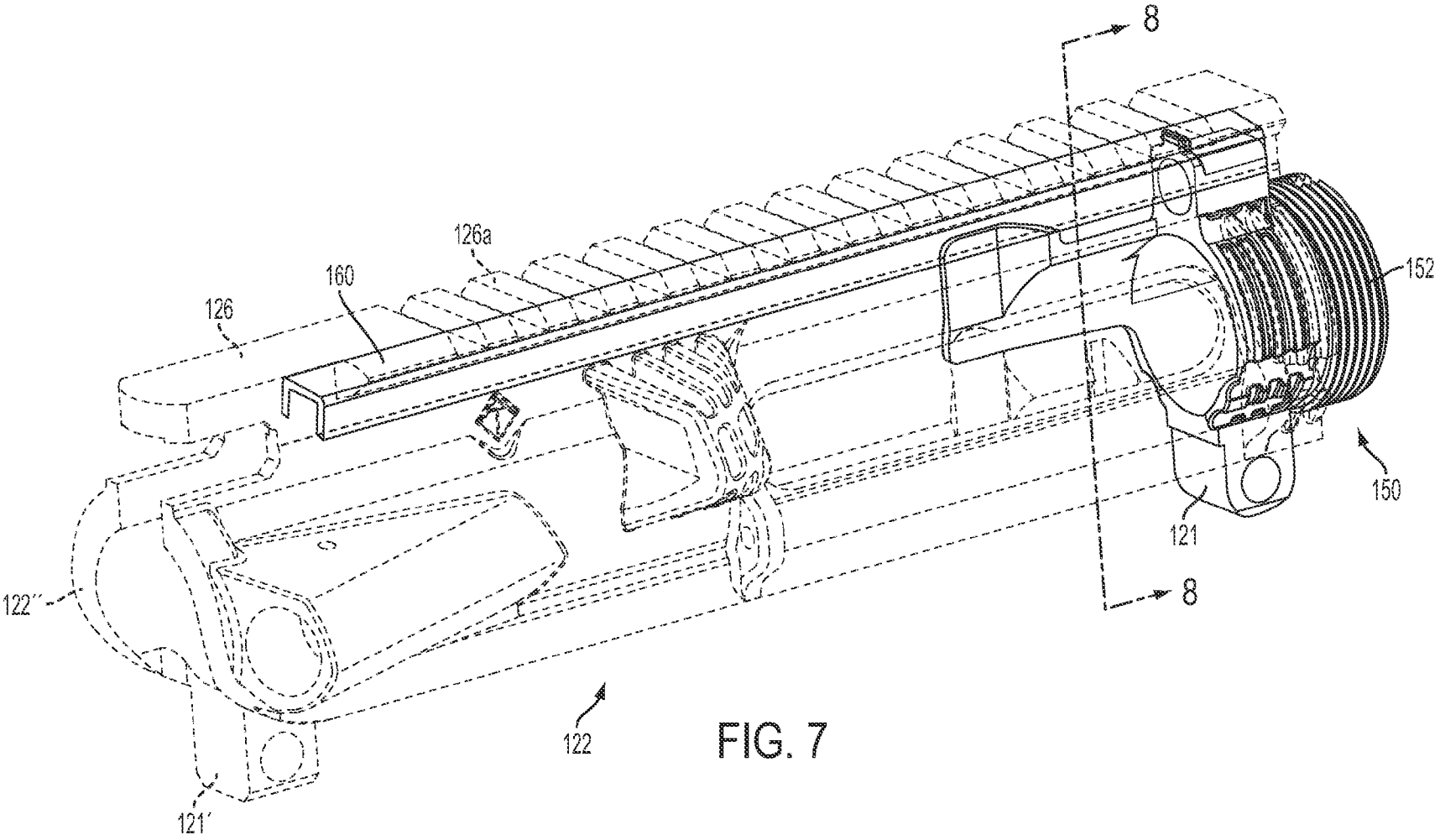
FIG. 7 is an environmental view of a hybrid upper receiver assembly in accordance with an embodiment of the present invention showing an embedded threaded metal insert and metal gas channel member in solid lines with a polymeric upper receiver housing shown in dashed lines.
Figure 8:
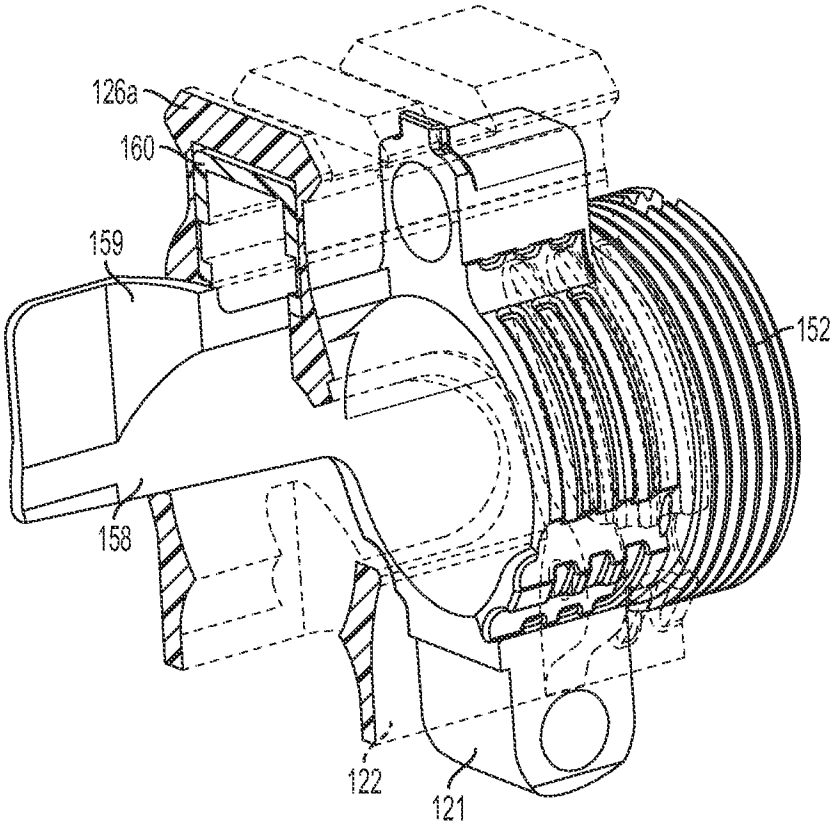
FIG. 8 is a cross-sectional view of a hybrid upper receiver assembly in accordance with an embodiment of the present invention as taken generally along the line 8-8 of FIG. 7.

In an additional embodiment, as shown in FIG. 6, the upper receiver assembly further includes a metal channel member 160. Preferably, channel member 160 has a generally U-shaped cross-section and includes a slot 162 adapted to engage with a stud 154*a* on lobe 154 of threaded member 150. Channel member 160 is situated within the upper internal surface of chamber 124 of the upper receiver housing 122. The external surfaces of the channel member 160 are preferably embedded within the polymeric material of the upper receiver housing (see FIGS. 7 and 8). The open channel of the U-shaped member is directed downward such that it opens toward the chamber 124 and is preferably not embedded within the polymer.

The downwardly depending arms 166 of the U-shaped member are generally proportioned so as to traverse a vertical distance such that the portion of gas tube 148 that rests within the upper receiver assembly is enveloped on three sides by the U-shaped channel member. In this manner, substantially all of the hot gasses which enter the upper receiver assembly encounter the metal channel member 160 rather than the polymeric material comprising the bulk of the assembly. Further, channel member 160 preferably extends substantially the entire length of the upper receiver assembly, and by being embedded within the polymeric material of the upper receiver housing proximate the ridge 126 and picatinny ridge 126*a*, channel member 160 provides additional structural support along the length of the upper receiver assembly thereby minimizing, and preferably eliminating, any flexing of the upper receiver assembly.

As discussed above and as shown in FIGS. 2-7, the upper receiver assembly of the present invention is constructed as an integrated hybrid polymer/metal unit wherein a threaded metal insert 150 (FIGS. 4 and 5), and an optional metal channel member 160 (FIG. 6), is secured within a polymeric upper receiver housing 122 (FIG. 3) (as assembled in FIGS. 2 and 7). Threaded metal insert 150 and metal channel member 160 can be constructed of any suitable metal, and are preferably constructed of aircraft grade aluminum, steel or a zinc alloy composition, for example. Similarly, the polymeric upper receiver housing 122 can be constructed of any suitable polymeric material, and is preferably constructed of glass reinforced nylon, for example.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A combination metal/polymer upper receiver for use in a rifle, the upper receiver comprising:

a) a polymeric upper receiver housing defining a chamber; and b) a metal insert secured within said polymeric upper receiver housing wherein said metal insert is configured to threadably engage a barrel nut to detachably secure a rifle barrel to said combination metal/polymer upper receiver.

2. The combination metal/polymer upper receiver of claim 1 wherein said metal insert further includes an extended member embedded within said polymeric upper receiver housing such that said extended member is adapted to receive impact from a bolt carrier group located within said chamber.

3. The combination metal/polymer upper receiver of claim 1 wherein said metal insert further includes a downwardly depending nodule adapted to detachably engage with one or more mounting features on a lower receiver proximate the rifle barrel to attach the lower receiver to said upper receiver.

4. The combination metal/polymer upper receiver of claim 1 wherein said metal insert further includes an upwardly protruding node configured to engage a gas tube wherein the gas tube may be positioned in fluid communication with the rifle barrel and the chamber.

5. The combination metal/polymer upper receiver of claim 1 further including a metal gas tube channel located along an upper internal surface of said polymeric upper receiver housing and wherein said gas tube channel extends a substantial length of said polymeric upper receiver housing.

* * * * *